United States Patent [19]

Turnbull et al.

[11] 4,210,988

[45] Jul. 8, 1980

[54] METHOD FOR MAKING AN INDIRECTLY-HEATED CATHODE ASSEMBLY

[75] Inventors: John C. Turnbull; Benjamin F. Yoder, both of Lancaster, Pa.

[73] Assignee: RCA Corporation, New York, N.Y.

[21] Appl. No.: 936,529

[22] Filed: Aug. 24, 1978

[51] Int. Cl.[2] ..... H01J 9/02; H01J 9/18

[52] U.S. Cl. ..... 29/25.15; 29/424

[58] Field of Search ..... 29/424, 25.13, 25.15

[56] References Cited

U.S. PATENT DOCUMENTS

| | | | |
|---|---|---|---|
| 2,413,731 | 1/1947 | Samuel | 316/19 |
| 3,118,080 | 1/1964 | Koppius | 29/424 X |
| 3,379,566 | 4/1968 | Hannan | 29/424 X |
| 3,696,498 | 10/1972 | Leontaritis | 29/424 |
| 3,822,392 | 7/1974 | Bowes et al. | 313/271 |

*Primary Examiner*—Richard B. Lazarus

*Attorney, Agent, or Firm*—E. M. Whitacre; G. H. Bruestle; L. Greenspan

[57] ABSTRACT

In a method for making an indirectly-heated cathode assembly, the steps of spacing the heater from the cathode substrate with a temporary volatilizable spacer, fixing the positions of the heater and cathode with respect to one another with the spacer therebetween, and then volatilizing the spacer.

10 Claims, 5 Drawing Figures

METHOD FOR MAKING AN INDIRECTLY-HEATED CATHODE ASSEMBLY

BACKGROUND OF THE INVENTION

This invention relates to a novel method for making an indirectly-heated cathode assembly, and particularly to a method wherein the heater is spaced from the cathode substrate.

A cathode-ray tube, for example a television picture tube, usually employs at least one electron gun with an indirectly-heated cathode assembly. Most color television picture tubes employ three such guns. That type of assembly includes a disc-shaped cathode substrate having an electron-emissive coating on the obverse surface thereof and a grid closely spaced from the coating. A coated-wire resistance heater is closely spaced from the other reverse surface of the substrate. The substrate may be supported on a tubular member, which may also contain the heater. All of the parts are attached to a common support means.

When the heater is operated, it expands due to the heat, and, if it is too close to the cathode substrate, it will press on the substrate and may deform the substrate. Since some of the electrical characteristics of the electron gun, particularly the cutoff voltage, are sensitive to the cathode-to-grid spacing, such deformation is undesirable. This deformation is particularly apparent with stiffer structures such as one using the one-piece bimetal cathode and sleeve described in RCA Technical Note 1159 by J. C. Turnbull, issued July 23, 1976.

U.S. Pat. No. 3,822,392 issued July 2, 1974 to R. J. Bowes et al suggests overcoming this and similar problems by mounting the heater with bimetal pieces which draw the heater away from the cathode substrate when the heater is operated. Such a structure, while it may be effective to overcome the problem, is too expensive and too complex for applications, such as home television, where cost is an important consideration.

SUMMARY OF THE INVENTION

In the novel method for making an indirectly-heated cathode assembly, the heater is spaced from the reverse surface of the cathode substrate with a spacer material. The spacer material is one which decomposes substantially entirely into volatile fragments upon heating. Then, the heater and substrate are permanently fixed, as by welding, in spaced positions with respect to each other. After the permanent fixing, the spacer material is heated to decompose it into volatile fragments leaving the desired cathode-to-heater spacing. The heating step may be carried out before or after the electron gun is assembled.

The novel method produces a consistent and predetermined spacing between the heater and the cathode substrate. The cathode-to-heater spacing is large enough to allow for the greatest expansion of the heater without deforming the cathode substrate. The spacer material is one that thermally decomposes into volatile fragments that do not adversely affect the heater, does not leave an undesirable residue, and does not require oxygen for complete decomposition. A preferred spacer material is n-butyl methacrylate which decomposes upon heating below about 450° C.

DETAILED DESCRIPTION OF THE PREFERRED EMBODIMENTS

Figure 1:
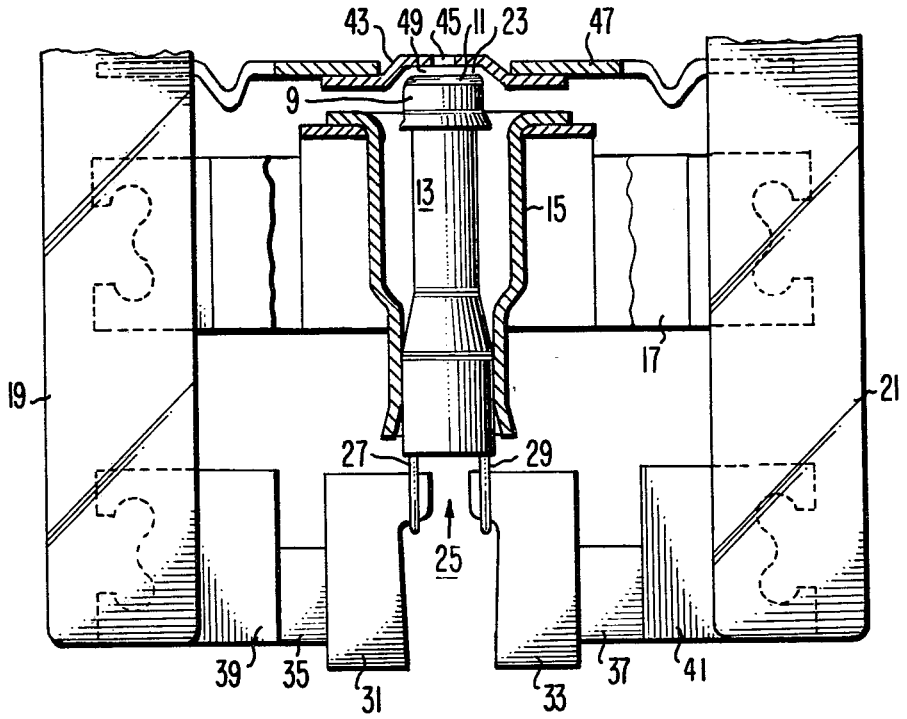
FIG. 1 is a broken-away sectional elevational view of a portion of a typical electron gun for a cathode-ray tube including an indirectly-heated cathode assembly that can be assembled according to the novel method.

The novel method may be applied to making the heater-cathode assembly for a cathode-ray tube shown in FIG. 1. Electron guns with cathode assemblies of this type are described in greater detail elsewhere; for example, in U.S. Pat. Nos. 3,772,554 issued Nov. 13, 1973 to R. H. Hughes and 3,952,224 issued Apr. 20, 1976 to J. Evans, Jr. The cathode-ray tube may have a single, indirectly-heated cathode assembly, as shown in FIG. 1. Or, the tube may have two or more such guns spaced closely together in the neck of the tube. For example, the tubes may employ three in-line electron guns as described in the above-cited patents to Hughes and Evans, Jr.

The assembly shown in FIG. 1 comprises a nickel-alloy cathode cup including a sidewall 9 and an integral endwall 11, which is the cathode substrate. The sidewall 9 is welded to one end of a cylindrical cathode sleeve 13, which is welded at its other end to a cathode eyelet 15, which is welded to a cathode support 17, which is embedded in glass beads 19 and 21 on each side thereof. The outer or obverse side of the endwall 11 carries a layer 23 of electron-emissive material. A double-spiraled coated wire resistance heater 25 is located in the sleeve 13. The heater legs or ends 27 and 29 of the wire heater 25 extend beyond the sleeve 13 and are welded to two tab legs 31 and 33, which are welded to two heater connectors 35 and 37 respectively, which are welded to two heater bead straps 39 and 41 respectively, which are embedded in the two glass beads 19 and 21 respectively.

A grid 43 having a grid aperture 45 therein is welded to a grid support 47, which is embedded in the beads 19 and 21. The grid 43 is spaced a precise and critical distance, referred to as the cathode-to-grid spacing 49, from the layer 23. The head of the wire heater 25 is spaced from the inner or reverse side of the substrate 11 by a predetermined distance at room temperature, referred to as the heater-to-cathode spacing. When a voltage is applied to the heater legs 27 and 29, electric current flows through the heater 25 causing its temperature to rise above 1000° C. Thermal expansion of the heater 25 with respect to the cathode substrate 11 causes physical movement therebetween. The heater-to-cathode spacing permits substantial movement without the head of the heater 25 pressing on the substrate 11 and causing either temporary or permanent deformation of the substrate 11. Deformation of the substrate 11 will change the critical cathode-to-grid spacing 49.

To make the assembly shown in FIG. 1, the grid 43, the cathode eyelet 15, the heater bead straps 39 and 41 and intermediate structures are assembled to the glass beads 19 and 21 by a known method, referred to in the art as beading; for example, as described in U.S. Pat. No. 2,950,568 issued Aug. 30, 1960 to R. D. Kissinger et al. Then, the cathode cup is welded to the sleeve 13 and the layer 23 of cathode material is applied to the substrate 11. Then, the cathode sleeve 13 is slid through the cathode eyelet 15, the spacing 49 between the layer 23 and the grid 43 is set at room temperature, and the sleeve 13 is welded to the eyelet 15 by any known method, referred to in the art as cathode-to-grid or K-G1 spacing; for example, by any manner described in U.S. Pat. No. 4,015,315 issued Apr. 5, 1977 to R. P. Stone.

Figure 2:
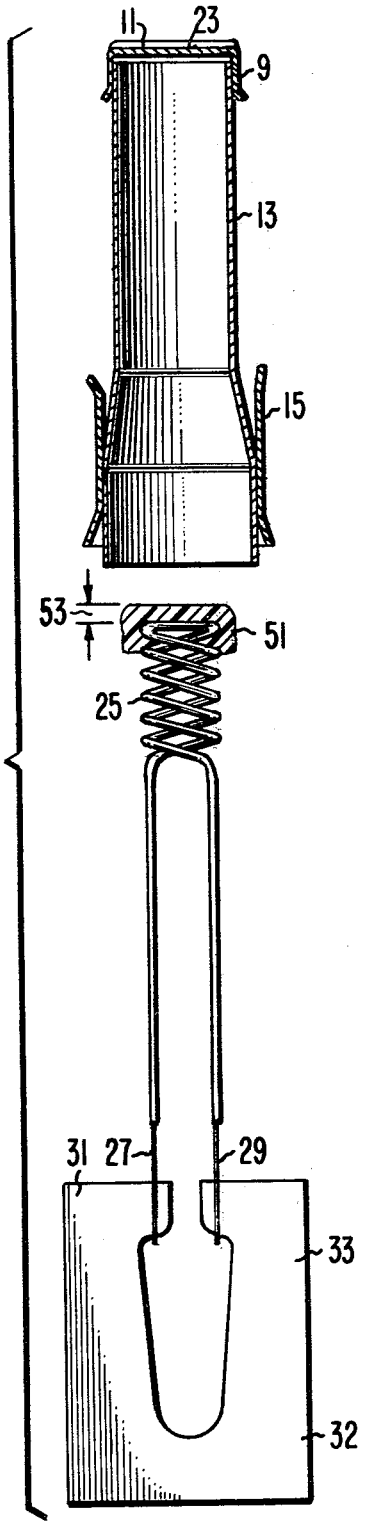
FIGS. 2 and 3 illustrate two steps in a preferred embodiment of the novel method.
Figure 3:
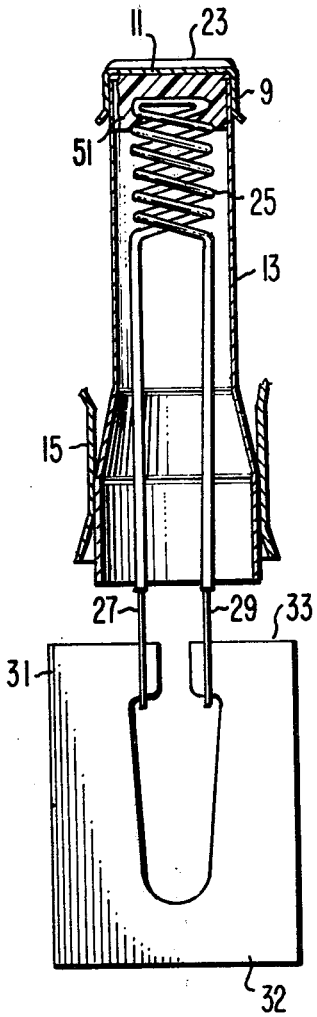

The heater legs 27 and 29 of the heater 25 are welded to a U-shaped tab 32 having tab legs 31 and 33 respectively as shown in FIG. 2. The other end or head of the heater 25 is inserted into a viscous solution of n-butyl methacrylate in toluene and permitted to dry, leaving a coating 51 extending a short distance in from the end of the heater 25 and extending the desired heater-to-cathode spacing 53 out from the head end of the heater 25. If a single coating is not sufficient to provide the desired spacing 53, then multiple coatings may be applied until the desired thickness of the spacing 53 is built up. A spacing of about 0.38 to 0.52 millimeter (15 to 20 mils) has been found to be practical. The heater 25 with the spacer coating 51 thereon is then aligned with the sleeve 13 and slid into the sleeve 13 head first until the spacer coating 51 presses lightly against the reverse side of the substrate 11 as shown in FIG. 3. The tab legs 31 and 33 are then welded to the heater connectors 35 and 37, which have been welded to the heater bead straps 39 and 41 respectively. Then, the cross bar on the U-shaped tab 32 is cut off. The method of using U-shaped tabs for heater-wire insertion is described in U.S. Pat. No. 3,555,640 issued Jan. 19, 1971 to C. L. Lundvall, II.

After the heater 25 is fixed in the assembly, an electric current is passed through the heater 25 to raise its temperature above 450° C. The heat causes the coating 51 to decompose substantially entirely into volatile fragments leaving the desired cathode-to-heater spacing. Since, as shown, there is little open space in the sleeve 13, the decomposition must occur without oxygen or other ambient gases present. Instead of n-butyl methacrylate, other materials which decompose substantially entirely into volatile fragments when heated may be used. This is a small class of materials including other acrylics, polyvinyl alcohols, ethyl cellulose, and nitrocellulose. The decomposition should not produce volatile fragments or residues that are destructive or degrading to the heater 25, the substrate 11 or the sleeve 13 in any substantial way. Also, the decomposition should not be explosive since that would defeat the purpose of the invention. In principle, solid materials which sublime or evaporate rapidly may be used, but no practical materials of these types are known. The lowest usable heating temperature is determined by the character of the spacer material used. Temperatures in the range of about 450° and 1250° C., which may be realized by operating the heater, may be used without damaging the assembly. The heating step may be conducted at any time after the heater 25 is fixed in the assembly, but it is preferred to be done at the time the tube is being exhausted of gases, when the gas pressure in the tube is substantially below atmospheric pressure. The heating step can be done after the tube is sealed.

Figure 4:
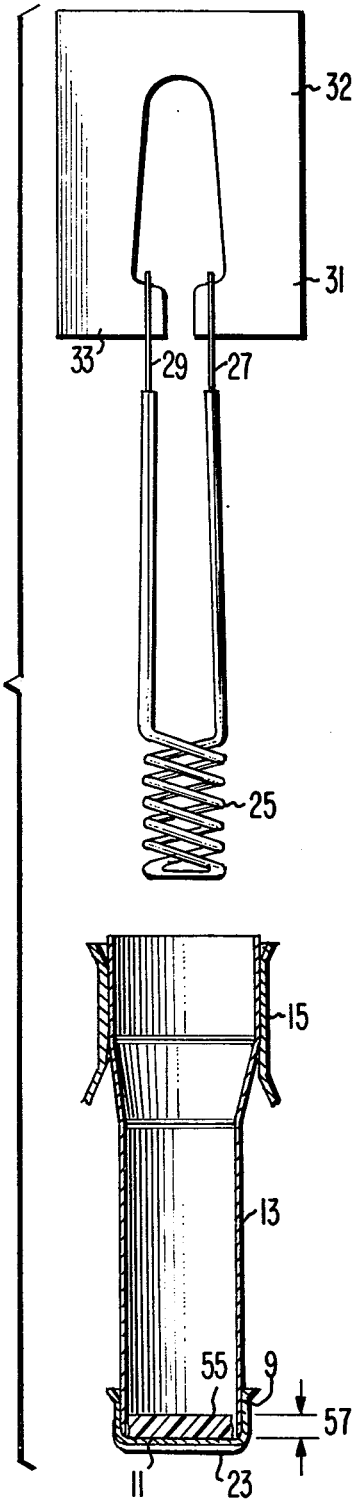
FIGS. 4 and 5 illustrate two steps in an alternative embodiment of the novel method.
Figure 5:
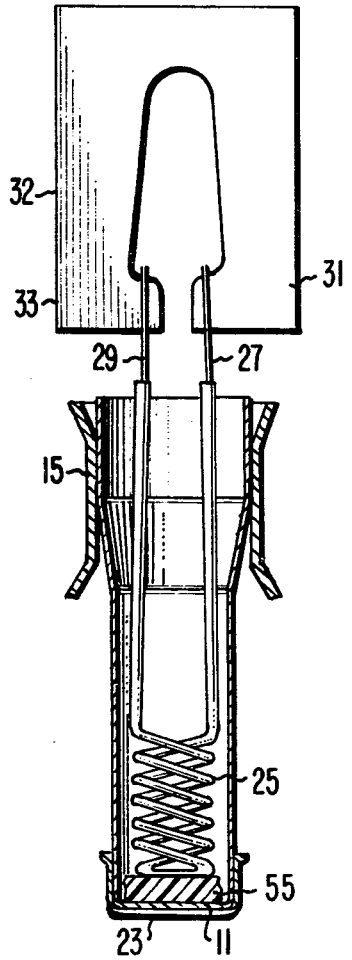

An alternative method is shown in FIGS. 4 and 5. A disc-shaped or washer-shaped spacer 55 having the thickness 57 of the desired cathode-to-heater spacing at room temperature is punched from a foil of n-butyl methacrylate or other suitable material. The spacer 55 is dropped into and held in place in the sleeve 13 adjacent the reverse surface of the substrate 11 by gravity. Then, the head of the tabbed wire heater 25 is slid into the sleeve 13 until it is up against the spacer 55, as shown in FIG. 5. The tab legs 31 and 33 are then welded to the heater connectors 35 and 37, and the cross bar on the U-shaped tab 32 is cut off. The heater 25 is raised in temperature as described above until the spacer has volatilized.

We claim:

1. In a method for making an indirectly-heated cathode assembly including a cathode substrate having electron-emissive material on one surface thereof and a heater fixedly spaced from the opposite surface thereof, the steps for assembling said heater to said cathode substrate comprising (a) spacing said heater from said opposite surface of said cathode substrate with a spacer material which, upon heating, decomposes substantially entirely into volatile fragments, (b) fixing said heater in said spaced position with respect to said cathode substrate (c) and then heating said spacer material to decompose it into volatile fragments.

2. The method defined in claim 1 wherein said spacer material is selected from the group consisting of acrylic polymeric materials, polyvinyl alcohols, ethyl cellulose and nitrocellulose.

3. The method defined in claim 1 wherein said spacer material consists essentially of acrylic polymeric materials which are substantially entirely decomposed by heating at temperatures below 450° C.

4. The method defined in claim 1 wherein said heating step is conducted at atmospheric pressure.

5. The method defined in claim 1 wherein said heating step is conducted in an ambient substantially below atmospheric pressure, and said volatile fragments are continually removed from said ambient.

6. In a method for making a cathode-ray tube comprising at least one electron gun having an indirectly-heated cathode assembly, said cathode assembly including a tubular cathode support having an open terminal end and a terminal end closed by an endwall, a layer of electron-emissive material disposed on the outer surface of said endwall and a wire resistance heater in said support positioned with the head of said heater toward the inner surface of said endwall and the legs of said heater extending from said open terminal end, the steps for assembling said heater to said cathode support comprising (a) providing a prescribed thickness of a solid, organic polymeric spacer material on at least one of (i) the inner surface of said endwall and (ii) the head of said heater, said spacer material being thermally decomposable into volatile fragments, (b) advancing the head of said heater into said cathode support until the head of said heater is spaced from said endwall solely by said spacer material, (c) permanently fixing said heater in said spaced position with respect to said cathode support, (d) and then heating said spacer material, said cathode support and said heater until said spacer material is substantially entirely decomposed into volatile fragments.

7. The method defined in claim 6 wherein said spacer material consists substantially entirely of n-butyl methacrylate.

8. The method defined in claim 6 wherein said heating step is conducted after said electron gun has been assembled into said tube and during the period when said tube is being exhausted prior to sealing.

9. The method defined in claim 6 wherein said heating step is conducted before said electron gun is assembled into said tube.

10. The method defined in claim 6 wherein said heating step is conducted at temperatures in the range of about 450° to 1250° C.

* * * * *